US008162697B1

(12) United States Patent
Menolotto et al.

(10) Patent No.: US 8,162,697 B1
(45) Date of Patent: Apr. 24, 2012

(54) TIP-SLEEVE SILENT PLUG WITH 360° SLIDING RING CONTACT

(75) Inventors: Paolo Menolotto, Mount Martha (AU); Thien Nguyen, Springvale (AU)

(73) Assignee: Amphenol Australia Pty Ltd, Victoria (AU)

( * ) Notice: Subject to any disclaimer, the term of this patent is extended or adjusted under 35 U.S.C. 154(b) by 0 days.

(21) Appl. No.: 12/965,416

(22) Filed: Dec. 10, 2010

(51) Int. Cl.
*H01R 24/04* (2006.01)

(52) U.S. Cl. ..... 439/669

(58) Field of Classification Search ..... 439/669, 439/675, 188; 200/51 R; 29/854
See application file for complete search history.

(56) References Cited

U.S. PATENT DOCUMENTS

| | | | | | |
|---|---|---|---|---|---|
| 328,280 | A | | 10/1885 | Lee | |
| 1,706,284 | A | | 3/1929 | Fortin | |
| 2,610,223 | A | * | 9/1952 | Puerner | 439/669 |
| 2,664,475 | A | | 12/1953 | Harlin | |
| 3,202,953 | A | | 8/1965 | Bosworth et al. | |
| 3,575,684 | A | | 4/1971 | McIntyre | |
| 3,600,531 | A | * | 8/1971 | Hoegerl | 200/51.1 |
| 3,626,360 | A | | 12/1971 | Cole | |
| 3,656,089 | A | | 4/1972 | Bailey | |
| 4,275,946 | A | * | 6/1981 | Manina et al. | 439/188 |
| 4,275,947 | A | * | 6/1981 | Takagi | 439/188 |
| 4,420,216 | A | | 12/1983 | Motoyama et al. | |
| 4,938,717 | A | | 7/1990 | Lau | |
| 5,238,422 | A | | 8/1993 | Scherer | |
| 5,290,179 | A | | 3/1994 | Weingartner | |
| 5,466,167 | A | * | 11/1995 | Scherer | 439/188 |
| 5,527,190 | A | | 6/1996 | Weingartner | |
| 5,911,601 | A | | 6/1999 | Weingartner | |
| 6,143,995 | A | * | 11/2000 | Ward | 200/51.05 |
| 6,193,559 | B1 | * | 2/2001 | Weingartner | 439/669 |
| 6,468,095 | B2 | | 10/2002 | Kerr, Jr. et al. | |
| 6,604,954 | B2 | | 8/2003 | Chu et al. | |
| 6,626,710 | B1 | | 9/2003 | Tsai Huang | |
| 6,770,986 | B2 | | 8/2004 | Nagao et al. | |
| 6,979,231 | B2 | * | 12/2005 | Shinohara | 439/669 |
| 7,618,294 | B1 | * | 11/2009 | Lin et al. | 439/669 |
| 7,758,365 | B2 | * | 7/2010 | Purchon | 439/188 |
| 2009/0011628 | A1 | | 1/2009 | Purchon | |

OTHER PUBLICATIONS

Planet Waves™ "Circuit Braker Cables" retrieved Jul. 20, 2011 (1 pg).
gig-fx™ Quiet Cable; retrieved Jul. 20, 2011 (3 pages).
Switchcraft Online Catalog; Silent-Plug Phone Plugs; Date unknown (3 pgs).
G&H Industries; Quiet Plug™ Part No. P-H90; Date unknown (1 pg).
Neutrik, NP2X-AU-Silent, Retrieved Jul. 20, 2011.

* cited by examiner

*Primary Examiner* — Alexander Gilman
(74) *Attorney, Agent, or Firm* — Blank Rome LLP

(57) ABSTRACT

A silent plug includes a switch adapted to be automatically opened when the connector is inserted into the jack and closed when the connector is not inserted into the jack to eliminate electronically generated noise that would otherwise occur when the plug is inserted. The switch has a sliding ring contact for providing the electrical connection between the tip contact and the ground sleeve and providing 360° contact with the ground sleeve via a bridging contact. A spring applies a force in the mating direction to urge the sliding ring contact into the closed position. An actuator facing the jack contacts the front face of the jack when the connector is inserted into the jack in order to urge the sliding ring contact in a direction opposite to the mating direction and against the force applied by the spring.

13 Claims, 7 Drawing Sheets

TIP-SLEEVE SILENT PLUG WITH 360° SLIDING RING CONTACT

FIELD OF THE INVENTION

The present invention is directed to a tip-sleeve plug and more specifically to a tip-sleeve plug with an automatically operating sliding ring contact so that the plug can be plugged into or unplugged from an electronic instrument or device such as an electric guitar under load without the spurious noise typically caused by doing so.

DESCRIPTION OF RELATED ART

A tip-sleeve (TS) connector, also called an audio jack, phone jack, phone plug, jack plug, stereo plug, mini-jack, mini-stereo, or headphone jack, is a common analog audio connector. It is cylindrical in shape, typically with two contacts, although sometimes with three (a TRS, or tip-ring-sleeve connector) or four (a TRRS connector). The TS connector was invented for use in telephone switchboards in the 20th century and is still widely used, both in its original ¼" (6.35 mm) size and in miniaturized versions: 3.5 mm (approx. ⅛") and 2.5 mm (approx. 3/32").

Such connectors are widely used by musicians to connect electronic devices and instruments to external amplifiers. However, when the plug is plugged into or unplugged from the electronic device or instrument under load, a loud popping sound or other spurious noise can often result. These noises are considered annoying and undesirable, especially in live concert performances or in recording studio environments.

Various techniques are known in the art to provide "silent plugs" that reduce or eliminate that noise. Fundamentally the way a "silent plug" operates is that the tip contact circuit (normally hot or live) is grounded by a switch mechanism to the sleeve/ground contact circuit in the normal (at rest or unconnected) status. The plug remains in this status up until the point at which the plug is almost fully mated to the jack (female receptacle), i.e., the point where the tip circuit of the plug is about to contact its corresponding circuit in the jack receptacle. At that point, the switch opens, and the plug goes "live," and the intended signal is then permitted to be transmitted to the external device.

A few such techniques will now be discussed.

U.S. Pat. No. 4,275,946 ("the '946 patent") relates to an electrical connecting plug. The '946 patent describes that a first electrode is slidably disposed in the second electrode and electrically isolated from the second electrode along the length thereof.

U.S. Pat. No. 4,275,947 ("the '947 patent") also relates to a plug for electric connections. The '947 patent describes a spring-loaded arrangement for short-circuiting a center lead rod to a side contact when the plug is out of a jack. The spring-loaded arrangement automatically releases the short circuit when the plug is completely inserted into the jack. According to the '947 patent, the relief member 15 (shown in FIG. 1 of that reference) is biased by a spring member 14, so that the protruding members 15a contact contactor 8. The contact with the protruding members 15a causes the contactor 8 to electrically connect rod 2 with cylindrical member 3 via the relief member 15, spring member 14, and plug body 12.

Neutrik Aktiengsellschaft of Schaan, Liechtenstein, markets a jack plug, model NP2C-AU-SILENT, for use in music electronics. The plug includes a small reed switch inside of the main grounding sleeve. An external sprung ring/button magnet (in the mating direction) activates the internal reed switch, as it moves backwards as the plug is fully mated to the jack.

Switchcraft Inc., of Chicago, Ill., U.S.A., markets silent plugs as disclosed in U.S. Pat. No. 2,664,475. Switchcraft's plugs use a single small pin (in the mating direction) protruding the main connector body. This pin extends to the back of the plug (internally to the housing) and switches to open contact with the tip circuit as the plug is fully mated to the jack.

Gig FX Inc.'s products use a button switch inside of the sleeve contact which acts perpendicularly to the mating direction. When the plug switch passes into the bore of a jack receptacle, the switch goes open circuit.

However, the prior art has problems in terms of reliability, ease of construction, and backwards compatibility. For example, internal reed switches require expensive manufacturing and lead to easy breakage. Also, many conventional parts have to be extensively redesigned.

Other known muting plugs have a manually operated switch which essentially interacts with the relevant circuits of the plug. An example is a product series marketed by D'Addario & Co and known as the Planet Waves Circuit Breaker Cable Series. Such products rely entirely on the user to remember to activate and de-activate the switch manually to achieve the muting effect, not to mention requiring additional features and work for switch mounting and soldering to manufacture.

SUMMARY OF THE INVENTION

It will be apparent from the above that a need exists in the art to address those problems.

It is therefore an object of the invention in at least some embodiments to enable musicians to plug and unplug their instruments from live amplifiers without the corresponding loud and annoying thumps, pops and squeals which can often be heard from conventional plug leads.

It is another object of the invention in at least some embodiments to do so within the constraints of the standards for conventional sizes of plugs as, of course, the plug needs to be fully reverse compatible with all existing systems and mating products.

It is yet another object of the invention in at least some embodiments to provide an automatically operating silent plug with higher reliability.

It is still another object of the invention in at least some embodiments to provide an automatically operating silent plug that can be made more competitively than current versions on the market.

To achieve the above and other objects, the present invention is directed to an automatically operating silent plug with a new switch design having a sliding ring contact moving parallel to the mating direction and providing 360° contact.

In contrast to the prior art having switches at the rear of the main body, with an open and close function in the direction of mating, the present invention has a switch in front of the connector body, which operates by a sliding ring contact action.

In contrast to the prior art having an internal reed switch, the present invention uses a spring button but not an internal reed switch. The button is not magnetic, nor does the button itself activate a switching function at the rear of the main contact body.

In contrast to the products marketed by Gif Fx Inc., while switching occurs at the forward point on the sleeve, i.e., in front of the main connector body, it is not activated in a direction perpendicular to mating and does not rely on activation by co-operation with the inside wall (ID) of the jack receptacle. It rather relies on activation from the front face of the jack receptacle.

In contrast to all of the above prior art, the present invention implements a "sandwiched build up" of tubular conducting, referred to as a tip bridge contact, and insulative layers referred to as the switch insulator along with other parts which are the parts of the original "generic" product. "Generic" here means the regular phone style or non "silent plug" types. The conductive sandwich layer or tip bridge contact extends from the internal shaft, which is part of the tip circuit, through to the standard external diameter of the sleeve circuit, which is the outside curved surface of the tip bridge contact.

The conductive sandwich layer or tip bridge contact is insulated from the other part of the sleeve circuit by the switch insulator component. Using a sliding ring contact, for example, a formed sliding switch contact or even a helical ring spring or other conductive element, inside of the plastic insulative actuator, the switch connects in a "circular" single-plane fashion the circuits of the tip and sleeve circuits when the actuator is in the out position, which is the normal position when not in use or not fully connected.

When the actuator is automatically depressed in the direction of mating, as it comes into contact with a jack receptacle front face, the sliding switch moves rearwards towards the main body, depressing the rear spring, and breaking contact with the tip bridge contact while still maintaining contact with the sleeve contact. In that rearward position, the sliding ring contact contacts the sleeve contact only, in a complete 360 degree fashion.

When the plug is to be removed from the jack receptacle, the opposite occurs. As the plug starts to be removed, the rear helical spring cooperates with the actuator, pushing it automatically forward to once again close the switch circuit and connect the tip circuit with the sleeve circuit, thereby once again applying the "muting effect."

By a simple adjustment of the position of the bridging contact, it is possible to easily change the function of the switch so that it is normally open in the non-plugged position but closed when in the plugged position.

The present invention offers the following advantages:

1. Reliability: As the present invention is the only one that works by sliding switch action, a natural wipe action is always applied to the contact surfaces on each use, preventing the buildup of oxidation on the contact surfaces. In addition the 360-degree sliding contact makes contact with one or more (two (2) in the preferred embodiment) potential shorting sections on the bridge contact while being in contact with the sleeve contact while in the closed position. The two (2) shorting sections on the bridge contact of the preferred embodiment, those that break through either side of the sleeve contact, provide for a degree of built in redundancy such that for the switch to operate effectively it is sufficient for just one point to be in contact with the ring contact along with the sleeve. Furthermore, the present invention switch actuation takes its reference from the full front face of the mated jack receptacle, which is deemed to be a more positive reference relative to prior art that references on the inside of internal bores (ID's) of jack receptacles as ID's (i) can more likely vary in diameter from standards due to manufacture quality and variability and/or (ii) provide clearances such that a mated plug may rest in an offset or angled position relative to the jack's true bore centre (non-concentric mating).

2. Simplicity: The present invention minimizes parts and allows the use of existing components to be part of the actual switch circuit. Furthermore, many of the components in the construction are held in place by the existing product structure in a sandwiched fashion, thereby reducing the need for additional fasteners or soldering points. As the switch mechanism is positioned forward of the main connector body and is self contained, the rear of the connector then appears standard to users, providing familiarity of construction to them as to correct soldering and wiring points.

3. Sealing: The present invention does not provide for a potential contamination ingress path either to the backshell area or the internals of the TS contact.

4. Assembly Difficulty and Cost: The present invention is simple and easy to assemble, as most of the parts are held together by elements that either already hold together existing generic product parts or fit onto new features embodied in the sleeve component. For example, the plastic actuator holds the ring contact and spring in place and fits into a switch cover which threads onto the machine sleeve body. The same effect can be achieved by use of a snapped on cover.

5. Competitiveness: As many of the switch parts are sandwiched in between existing sections of the construction, the entire insert assembly falls within the original generic product envelope, meaning that the standard housings, tip contacts, solder bucket, strain relief, and backshell components can be used, thereby leveraging these higher volume competitive parts in the cost build up. The sandwiched construction of the switch mechanism additional means that the need for additional fasteners or soldered joints is avoided.

6. The plug according to the present invention is mechanically stronger and more robust than those of the prior art because of the sandwiched buildup of solid sections in the tip construction. Furthermore, the sliding ring construction is essentially mechanical in nature and does not incorporate any soldered joints.

7. As opposed to the above-noted manually operated switch products, the switch according to the present invention is activated automatically just through the inherent use of the plug. The clear advantage of the present invention is that the user does not need to perform an additional conscious deliberate action, apart from the simple act of plugging or unplugging, every time it is plugged and unplugged to ensure a muting effect.

BRIEF DESCRIPTION OF THE DRAWINGS

A preferred embodiment of the present invention will be set forth in detail with reference to the drawings, in which.

DETAILED DESCRIPTION OF THE PREFERRED EMBODIMENT

Figure 3:
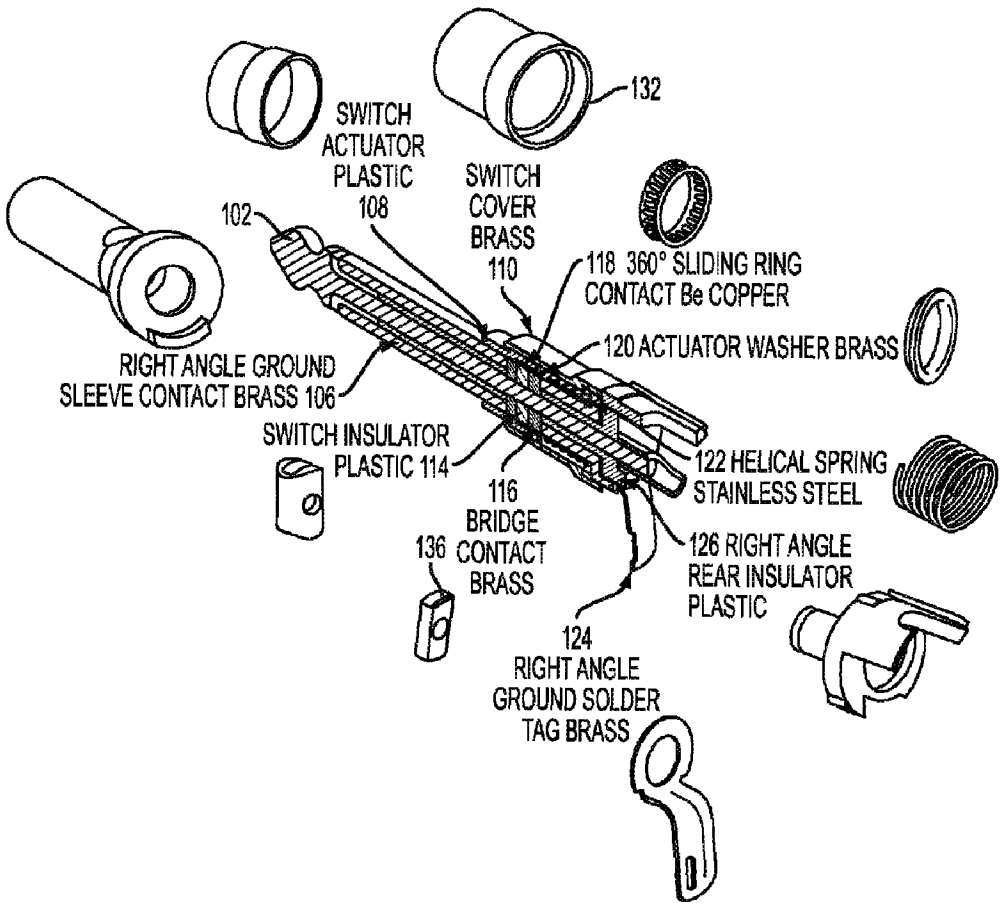
FIG. 3 shows a perspective cross-sectional view with various elements magnified.

A preferred embodiment of the present invention will now be set forth in detail with reference to the drawings, in which like reference numerals refer to like elements or steps throughout. The preferred embodiment has two variations, namely, a right-angled plug and a straight plug. Those skilled in the art who have reviewed the present disclosure will readily appreciate that the two variations of the preferred embodiment are not disclosed in order of importance, prominence, or expected commercial value.

Figure 1:
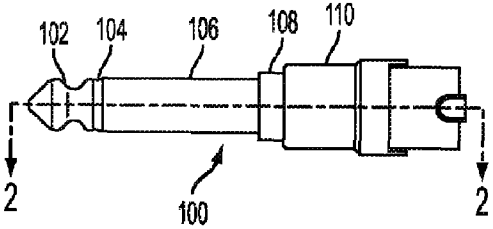
FIG. 1 shows an external view of a plug according to the right-angled variation of the preferred embodiment.
Figure 2:
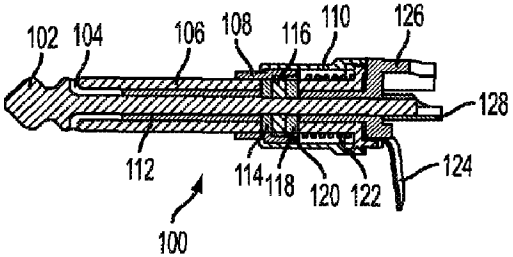
FIG. 2 shows a cross-sectional view along lines II-II in FIG. 1.
Figure 4:
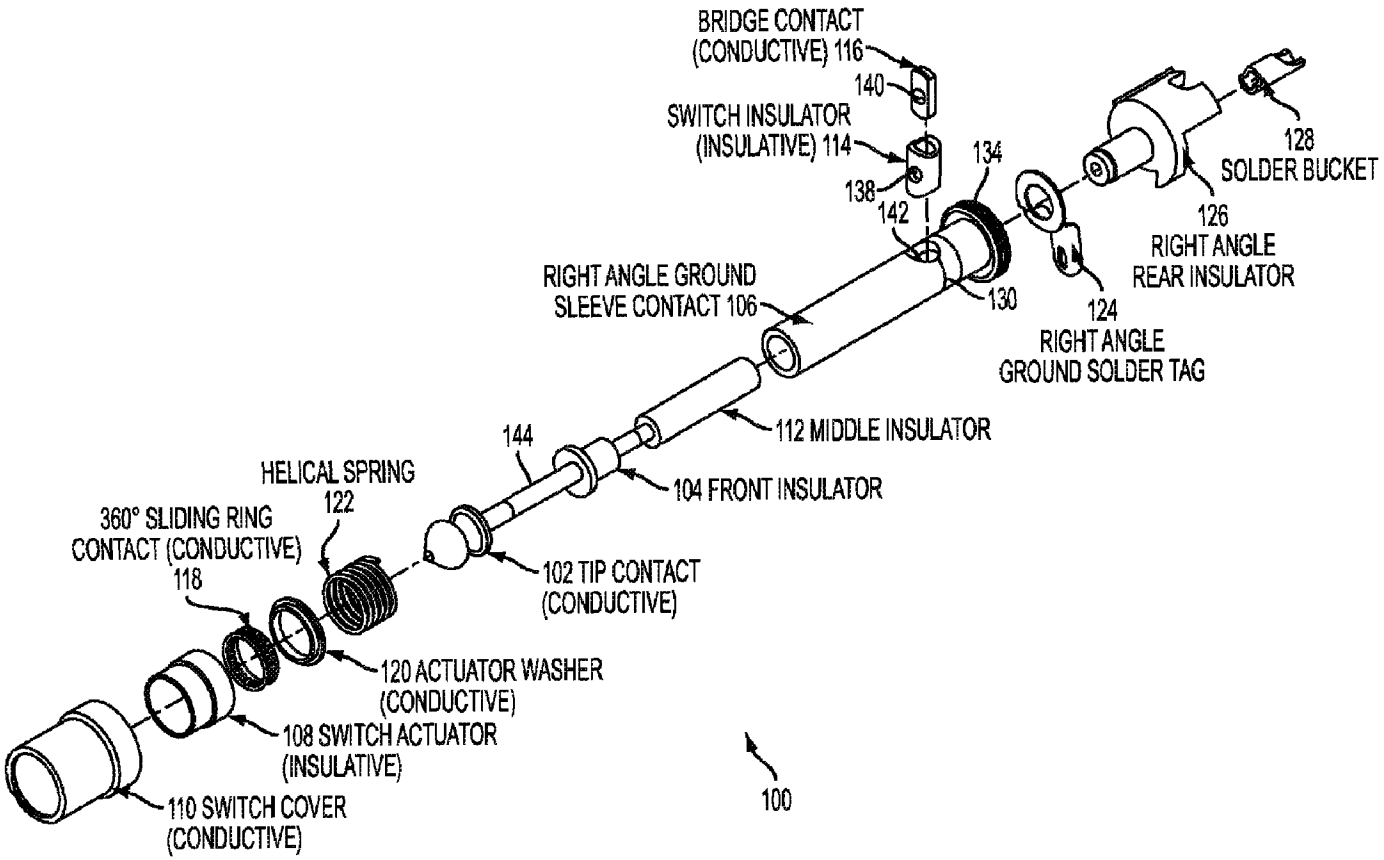
FIG. 4 shows an exploded view.

FIG. 1 shows an external view of a plug according to the right-angled variation of the preferred embodiment. FIG. 2 shows a cross-sectional view along lines II-II in FIG. 1. FIG. 3 shows a perspective cross-sectional view with various elements magnified. FIG. 4 shows an exploded view.

As shown in FIG. 1, the right-angled plug 100 includes the following externally visible components: a conductive brass tip contact 102, a front insulator 104, a conductive brass right-angle ground sleeve contact 106, a plastic switch actuator 108, and a conductive brass switch cover 110. The views of FIGS. 2-4 also show the following components: a middle insulator 112, a plastic switch insulator 114, a conductive brass bridge contact 116, a conductive 360° sliding ring contact 118, a conductive brass actuator washer 120, a steel helical spring (or other suitable elastic member) 122, a brass right-angle ground solder tag 124, a plastic right-angle rear insulator 126, and a solder bucket 128.

The plug 100 is assembled in the following manner. The front insulator 104 and the middle insulator 112 are disposed on the shaft 144 of the tip contact 102. The bridge contact 116 is inserted into the switch insulator 114, and the two are inserted into a through hole 142 in the ground sleeve contact 106. Then the tip contact 102 is inserted into the ground sleeve contact 106 such that the part of the shaft 144 extending beyond the middle insulator 112 extends through the hole 138 and the switch insulator 114 and the hole 140 in the bridge contact 116, thereby providing an electrical connection between the tip contact 102 and the bridge contact 116. The helical spring 122, the actuator 120, the sliding ring contact 118, and the switch actuator 108 are placed over the ground sleeve contact 106 and then held in place when the switch cover 110 is screwed onto a threaded portion 134 of the ground sleeve contact 106. The ground solder tag 124, the rear insulator 126, and the solder bucket 128 are attached to a rear portion of the plug 100.

Except for the switching operation, which will be described in detail below, the plug 100 operates like any conventional TS plug. That is, the tip contact 102 and the ground sleeve contact 106 are electrically connected by a cable (not shown) to corresponding terminals of audio or other equipment. When the plug 100 is inserted into a jack (not shown), the tip contact 102 and the ground sleeve contact 106 make electrical connection with corresponding connectors in the jack. Thus, an electrical connection is established from the audio equipment via one conductor in the cable and the tip contact 102 to one connector in the jack and from the other connector in the jack via the ground sleeve contact and the other conductor in the cable back to the audio equipment.

The moving switch components are located outside of the ground sleeve contact. Thus, the tip contact, the front and middle insulators, and the ground sleeve contact can be assembled to form a solid body having a sandwich construction, and no interior empty spaces need be provided in the plug formed by those components. As a result, the plug of the preferred embodiment provides easier assembly and more rugged construction than the prior art.

Figure 5:
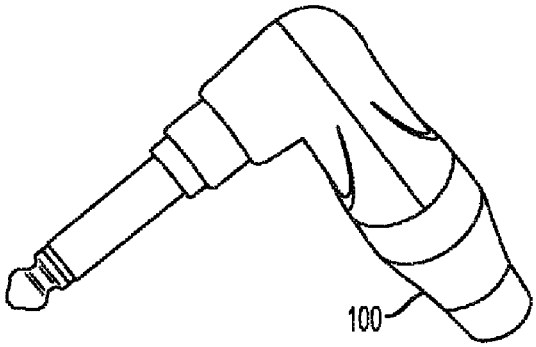
FIGS. 5-7 show three views of the right-angled plug.
Figure 6:
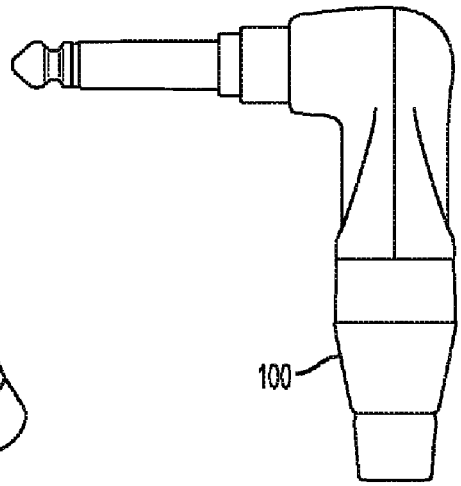
Figure 7:
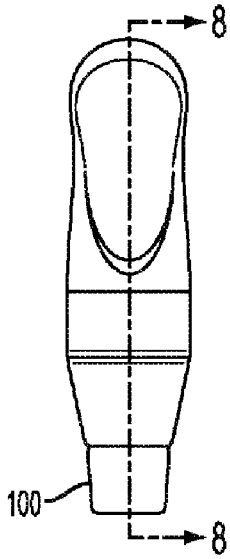
Figure 8:
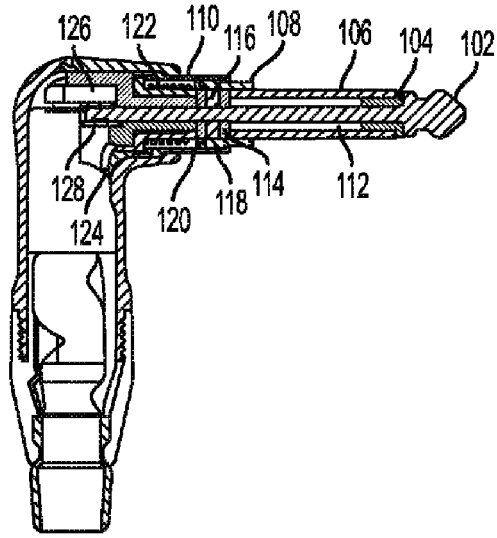
FIG. 8 shows a cross-sectional view taken along lines VIII-VIII in FIG. 7.

FIGS. 5-7 show three views of the right-angled plug 100. FIG. 8 shows a cross-sectional view taken along lines VIII-VIII in FIG. 7.

Figure 9:
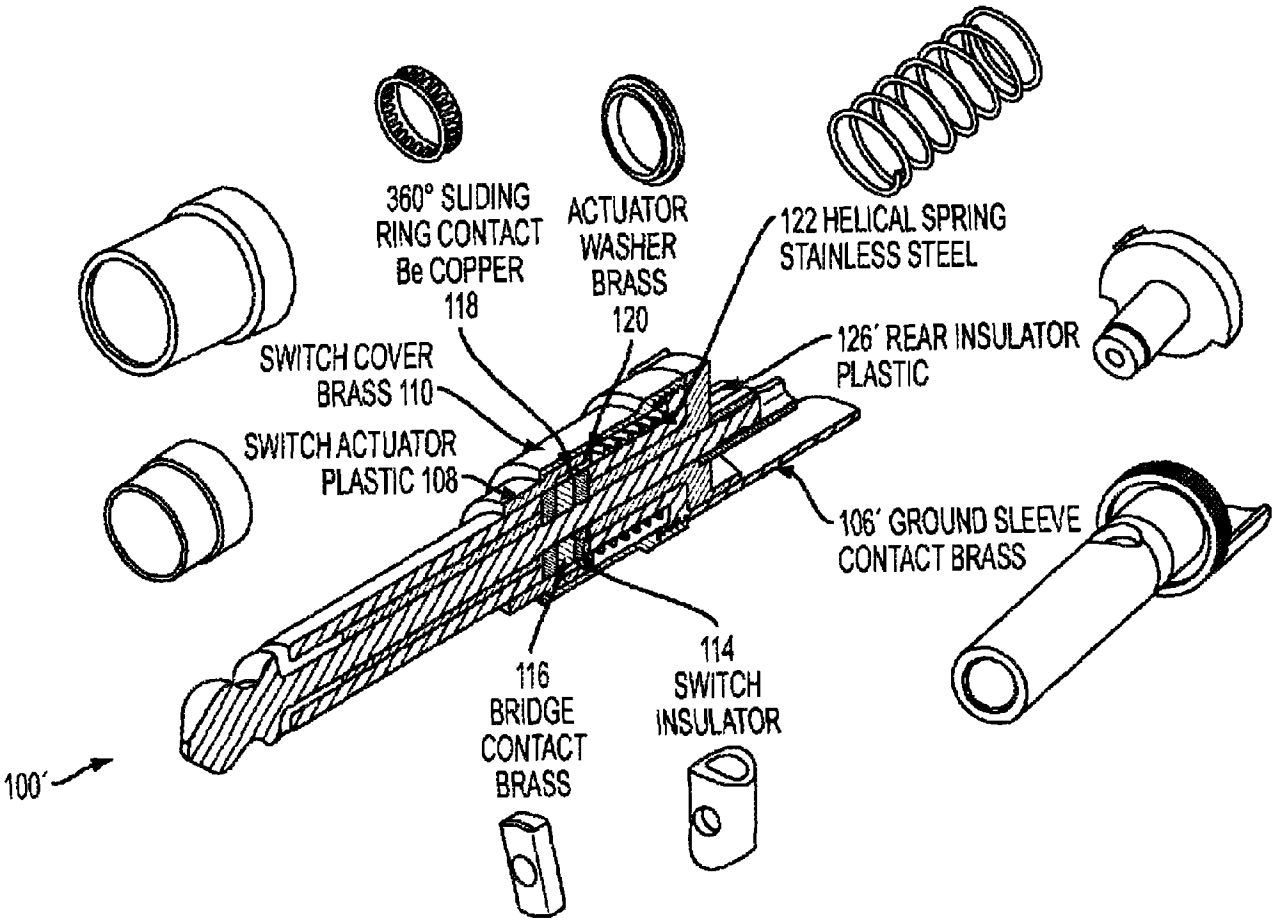
FIG. 9 shows a cross-sectional view of a straight plug according to a second variation of the preferred embodiment.
Figure 10:
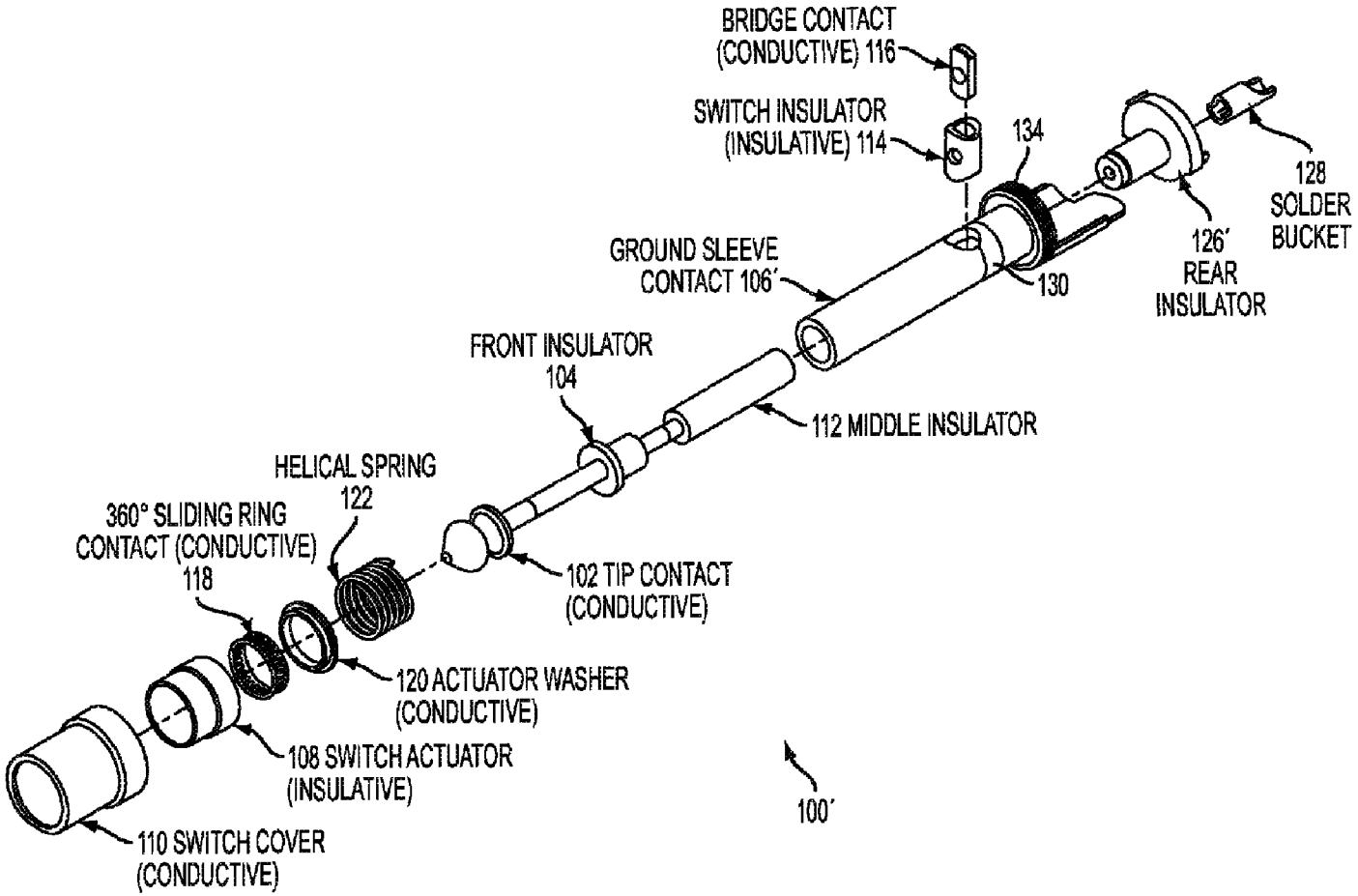
FIG. 10 shows an exploded view of the plug of FIG. 9.

FIG. 9 shows a cross-sectional view of the straight plug 100' according to the second variation of the preferred embodiment. FIG. 10 shows an exploded view. The ground sleeve contact 106' and the rear insulator 126' are shaped differently to accommodate a straight rather than right-angled plug. Other than that, the construction is the same as that of the right-angled plug 100 of the first variation of the preferred embodiment.

Figure 12:
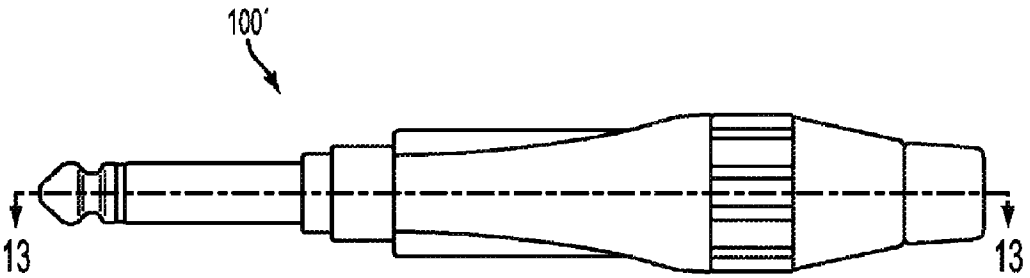
FIGS. 11 and 12 show two views of the straight plug.
Figure 13:
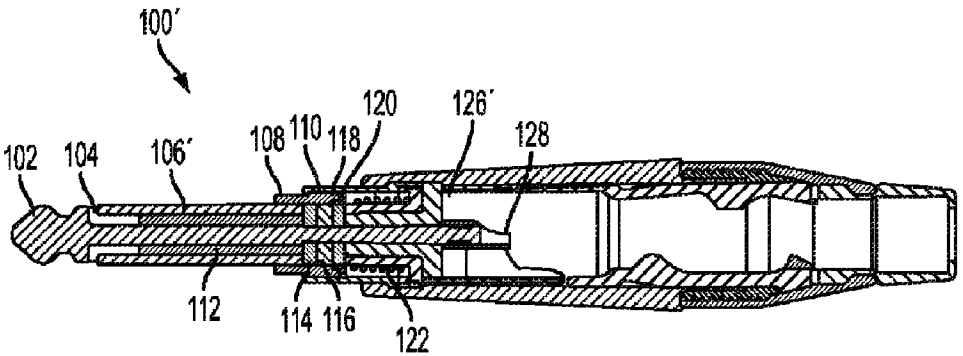
FIG. 13 shows a cross-sectional view taken along lines XIII-XIII in FIG. 12.
Figure 11:
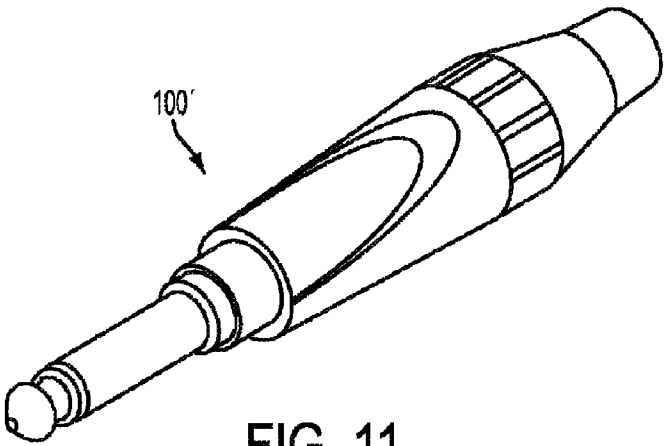

FIGS. 11 and 12 show two views of the straight plug. FIG. 13 shows a sectional view taken along lines XIII-XIII in FIG. 12.

Figure 14:
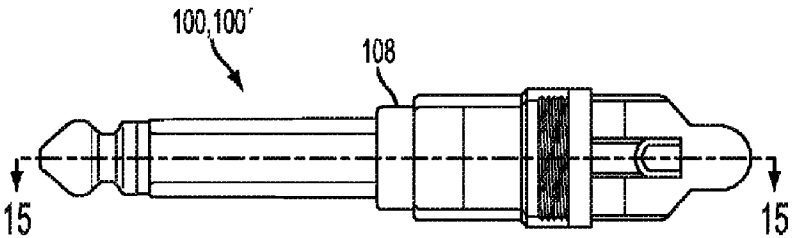
FIG. 14 shows the plug with the switch in the closed position.
Figure 15:
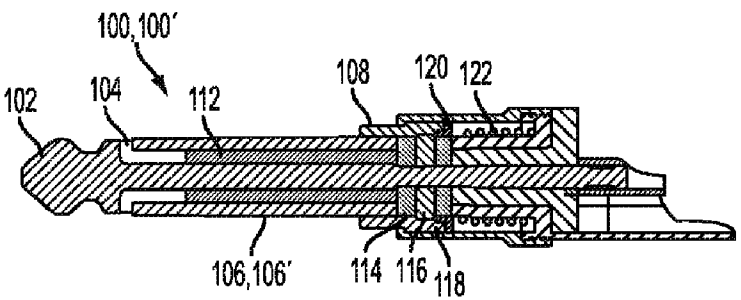
FIG. 15 is a cross-sectional view taken along lines XV-XV in FIG. 14.

The operation of the preferred embodiment, applicable to both variations, will now be explained with reference to FIGS. 14-17. FIG. 14 shows the plug 100 or 100' with the switch in the closed position, which occurs when the plug is not in use or not fully inserted. FIG. 15 is a cross-sectional view taken along lines XV-XV in FIG. 14. As shown, the helical spring 122 urges the actuator washer 120, the sliding ring contact 118, and the switch actuator 108 forward such that the sliding ring contact 118 contacts the bridge contact 116. In that position, since the bridge contact 116 is in electrical connection with the tip contact 102, and since the actuator washer is in electrical contact with the ground sleeve contact 106 or 106', an electrical connection is established from the tip contact 102 via the bridge contact 116, the sliding ring contact 118, and the actuator washer 120 to the ground sleeve contact 106. That electrical connection creates a short circuit from the tip contact 102 to the ground sleeve contact 106 or 106', so that the insertion of the plug into the jack does not have the usual electrical effect and thus does not cause the usual noise.

Figure 16:
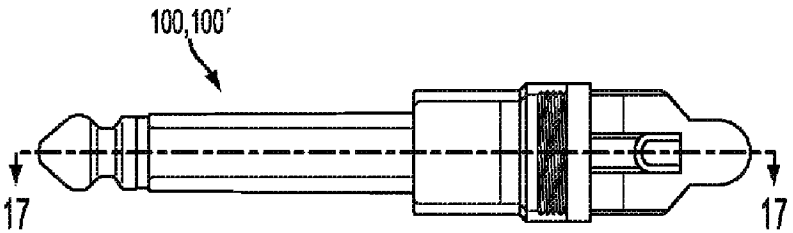
FIG. 16 shows the plug with the switch in the open position.
Figure 17:
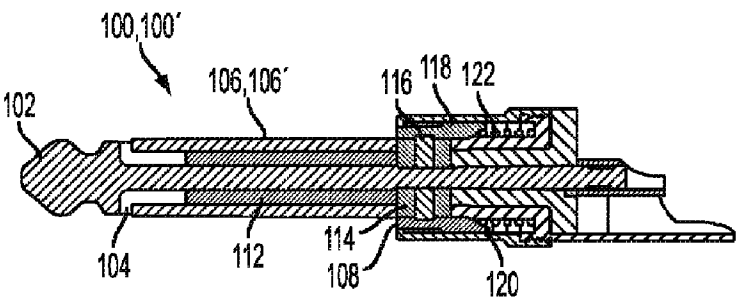
FIG. 17 shows a cross-sectional view taken along lines XVII-XVII in FIG. 16.

When the plug is fully inserted, the switch actuator 108 contacts the face of the jack and is pushed fully back, as shown in FIG. 16. FIG. 17 shows a cross-sectional view taken along lines XVII-XVII in FIG. 16. The switch actuator 108 in turn pushes back the sliding ring contact 118 and the actuator washer 120 against the force applied by the spring 122. Since the sliding ring contact 118 is no longer in electrical contact with the bridge contact 116, and since the tip contact 102 is otherwise insulted from the ground sleeve contact 106 or 106' by the insulators 104, 112, and 114, the above-described short circuit is broken, thereby opening the switch and breaking the electrical connection between the tip contact and the ground sleeve contact.

The following modifications can be introduced to improve reliability and cost-effectiveness. A slight reduction of the diameter of the ground sleeve contact is introduced in a short section to the rear of the bridge contact, shown in FIGS. 4 and 10 as 130. This is done for two reasons:

a. to reduce the frictional forces present when the sliding ring contact moves away from the bridge contact, thereby allowing the sliding ring contact to move more freely back and forth; and b. to reduce the manufacturing precision necessary in many parts of the switch assembly.

The bridge contact now extends slightly outwardly from the ground sleeve contact's reduced-diameter section and is chamfered on its leading and following edges (edges 136 of FIG. 3). The leading edge is the only functional edge; however, both sides are chamfered for symmetry in order to allow the bridge contact to be flexibly orientated in either direction on assembly, thereby facilitating assembly.

The switch mechanism can be protected by a separate threaded switch cover (threading 132 of FIG. 3). The ground sleeve contact rear is correspondingly threaded (threading 134 of FIGS. 4 and 10) to accept the threaded switch cover. The switch cover can alternatively an interference press part (snap fit) into the ground sleeve contact element. The cover is preferably a threaded cover for a number of reasons:

a. to improve the ease of manufacture of the ground sleeve contact component, b. to improve the ease of assembly of all of the moving switch parts in manufacturing, and c. to make the switch potentially re-enterable for servicing (if ever required).

While a preferred embodiment having two variations has been set forth above, those skilled in the art who have reviewed the present disclosure will readily appreciate that other embodiments, as well as other variations within the preferred embodiment, can be realized within the scope of the present invention. For example, recitations of certain materials and dimensions are illustrative rather than limiting; for example, the plug can be configured to fit any jack diameter. Also, the invention can be adapted to various forms of TS, TRS, TRRS, etc. plugs, i.e., plugs having various numbers of rings in addition to the tip and the sleeve. Moreover, the invention is not limited to audio applications, but can instead be used in any setting involving plugs and jacks. Furthermore, as noted above, an embodiment could easily be realized in which the switch is open in the non-plugged position but closed when in the plugged position. Therefore, the present invention should be construed as limited only by the appended claims.

What is claimed is:

1. A connector for establishing an electrical connection with a jack having a front face by insertion of the connector into the jack in a mating direction, the connector comprising:

a tip contact;

an insulator surrounding the tip contact;

a bridge contact in electrical connection with the tip contact and extending through the insulator;

a ground sleeve contact surrounding the insulator such that the insulator provides insulation between the tip contact and the ground sleeve contact; and a switch adapted to be automatically switched from a first one of an open state and a closed state to a second one of the open state and the closed state when the connector is inserted into the jack and switched back to the first one of the open state and the closed state when the connector is not inserted into the jack, the switch providing an electrical connection between the tip contact and the ground sleeve contact when the switch is closed, the tip contact and the ground sleeve contact being insulated from each other when the switch is open;

wherein the switch comprises:

a sliding ring contact for providing the electrical connection between the tip contact and the ground sleeve contact through the bridge contact, the sliding ring contact providing general 360° contact with the ground sleeve contact and contact with the bridge contact;

an elastic member that applies a force in the mating direction to urge the sliding ring contact into a position in which the switch is in the first one of the open state and the closed state; and a switch actuator adapted to contact the front face of the jack when the connector is inserted into the jack in order to urge the sliding ring contact in a direction opposite to the mating direction and against the force applied by the elastic member.

2. The connector of claim 1, wherein the elastic member comprises a spring.

3. The connector of claim 1, wherein the bridge contact extends through the insulator to provide two points of contact with the sliding ring contact.

4. The connector of claim 3, wherein the ground sleeve contact has an overall first diameter and comprises a reduced-diameter portion having a second diameter less than the first diameter, the reduced-diameter portion being adjacent to the bridge contact to allow movement of the sliding ring contact.

5. The connector of claim 3, wherein the switch further comprises a switch insulator surrounding the bridge contact to insulate the bridge contact from the ground sleeve contact when the switch is open.

6. The connector of claim 5, wherein the tip contact, the bridge contact, the insulator, the switch insulator, and the ground sleeve contact, when assembled together, form a sandwich construction.

7. The connector of claim 3, wherein the bridge contact has a chamfered leading edge.

8. The connector of claim 7, wherein the bridge contact also has a chamfered following edge.

9. The connector of claim 1, wherein the sliding ring contact comprises a conductive washer adjacent to the elastic member.

10. The connector of claim 1, wherein the insulator comprises a front insulator and a middle insulator.

11. The connector of claim 1, wherein the tip contact, the bridge contact, the insulator, and the ground sleeve contact, when assembled together, form a sandwich construction.

12. The connector of claim 11, wherein the sandwich construction defines a plug with no interior empty spaces.

13. The connector of claim 1, wherein the sliding ring contact, the elastic member, and the switch actuator are all disposed outside of the ground sleeve contact.

* * * * *